US007949238B2

(12) United States Patent
Barnes et al.

(10) Patent No.: US 7,949,238 B2
(45) Date of Patent: May 24, 2011

(54) HEATING ELEMENT FOR APPLIANCE

(75) Inventors: Ronald R. Barnes, Murfreesboro, TN (US); Robert Cockrell, Murfreesboro, TN (US); Richard Tao, Shenzhen (CN); Victor Yang, Guangzhao (CN)

(73) Assignee: Emerson Electric Co., St. Louis, MO (US)

( * ) Notice: Subject to any disclaimer, the term of this patent is extended or adjusted under 35 U.S.C. 154(b) by 813 days.

(21) Appl. No.: 11/656,042

(22) Filed: Jan. 19, 2007

(65) Prior Publication Data

US 2008/0175572 A1 Jul. 24, 2008

(51) Int. Cl.
*H05B 3/40* (2006.01)
*H05B 3/02* (2006.01)

(52) U.S. Cl. ..... 392/497; 219/538; 219/546

(58) Field of Classification Search ..... 392/497; 219/538–552

See application file for complete search history.

(56) References Cited

U.S. PATENT DOCUMENTS

| | | | | | |
|---|---|---|---|---|---|
| 2,546,315 | A | * | 3/1951 | Oakley | 219/58 |
| 2,933,805 | A | * | 4/1960 | Mcorlly | 29/615 |
| 2,996,599 | A | * | 8/1961 | Powers | 219/544 |
| 2,007,235 | A | * | 11/1961 | Yohe | 29/614 |
| 3,113,284 | A | * | 12/1963 | Inthoudt | 338/274 |
| 3,330,034 | A | * | 7/1967 | Price | 29/611 |
| 3,476,916 | A | * | 11/1969 | La Van | 219/552 |
| 3,613,051 | A | * | 10/1971 | Folkenroth et al. | 439/682 |
| 3,622,935 | A | | 11/1971 | Oakley | |
| 3,928,909 | A | * | 12/1975 | Saku | 29/611 |
| 3,934,333 | A | * | 1/1976 | Churchill | 29/611 |
| 4,001,547 | A | * | 1/1977 | Boggs et al. | 392/497 |
| 4,186,369 | A | * | 1/1980 | Attridge et al. | 338/274 |
| 4,273,993 | A | * | 6/1981 | Seeley | 219/541 |
| 4,346,277 | A | | 8/1982 | Wojtecki et al. | |
| 4,359,977 | A | * | 11/1982 | Sperner et al. | 123/145 A |
| 4,543,469 | A | * | 9/1985 | Cunningham | 392/457 |
| 4,687,905 | A | * | 8/1987 | Cunningham et al. | 392/498 |
| 4,900,897 | A | * | 2/1990 | Cunningham et al. | 392/503 |
| 4,926,030 | A | | 5/1990 | Knauss | |
| 5,034,595 | A | | 7/1991 | Grendys | |
| 5,247,158 | A | * | 9/1993 | Steinhauser et al. | 219/544 |
| 5,380,987 | A | * | 1/1995 | Morici | 219/544 |
| 5,408,579 | A | * | 4/1995 | Hunt | 392/498 |
| 5,459,812 | A | * | 10/1995 | Taylor | 392/498 |
| 5,644,835 | A | | 7/1997 | Villringer | |
| 5,864,941 | A | | 2/1999 | Baichoo et al. | |
| 5,920,135 | A | * | 7/1999 | Ohshita | 310/71 |

(Continued)

FOREIGN PATENT DOCUMENTS

EP 86465 A1 * 8/1983

*Primary Examiner* — Thor S. Campbell

(74) *Attorney, Agent, or Firm* — Harness, Dickey & Pierce, P.L.C.

(57) ABSTRACT

An improved construction for a heating element for an appliance is disclosed. A coiled resistance wire extending coaxially along the length of an elongate sheath is surrounded by an electrically insulating, high thermally conductive material that fills the sheath around the wire. The resistance wire is secured to a terminal pin at a connection comprising a connection insert that is securely affixed to the terminal pin, intermediate the terminal pin and resistance wire. The resistance wire is then able to be welded to the connector to provide a superior mechanical connection between a terminal pin and the resistance wire, even though the terminal pin is made from copper. The disclosed construction, therefore, provides good electrical and thermal conductivity and resists the tendency to separate during manufacture.

17 Claims, 4 Drawing Sheets

U.S. PATENT DOCUMENTS 5,978,550 A * 11/1999 Rochelle ..... 392/501
6,191,400 B1 2/2001 Cunningham
6,415,104 B1 * 7/2002 Fitts et al. ..... 392/503
7,064,303 B2 6/2006 Johnson
7,077,198 B2 * 7/2006 Vinegar et al. ..... 166/245
7,496,284 B2 * 2/2009 Pleschinger et al. ..... 392/480
2003/0205560 A1 11/2003 Desloge

* cited by examiner

HEATING ELEMENT FOR APPLIANCE

FIELD

The present disclosure relates to a heating element for an appliance. In particular, the present disclosure relates to an improved construction for a heating element such as a water-immersed heating element, for example.

BACKGROUND

The statements in this section merely provide background information related to the present disclosure and may not constitute prior art.

Appliances, such as dishwashers, clothes washers and water heaters, for example, employ a heating element for heating water or other liquid that is used in the appliance. The heating element is immersed in the water to be heated. When the heating element is energized, it produces heat that is transferred to the surrounding water.

Such heating elements generally comprise a resistance heater that produces heat when an electrical current is passed through it. A typical tubular heating element comprises a coiled resistance wire extending coaxially along the length of an elongate metal sheath. An electrically insulating material having a relatively high thermal conductivity is used to fill the space between the coil and the inner wall of the sheath. The resistance wire is commonly made from metals such as Fe/Cr/Al or Ni/Cr. Granulated magnesium oxide (MgO) is one substance known to be suitable for serving as the filler material.

During the heating element's manufacturing process, the granulated magnesium oxide is introduced into the sheath. The sheath is subsequently subjected to a compression force, which causes the sheath to reduce in diameter, increase in length and compact the granulated magnesium oxide inside. In the compacted state, the magnesium oxide's dielectric and thermal conductive properties are improved. As a result of the compacting process, the heating element may be "partially compacted" (e.g., the diameter of the heating element is reduced by approximately 15% or less of its original diameter, such as from 0.375 in. to 0.334 in. (8.5 mm)) or "fully compacted" (e.g., the diameter of the heating element is reduced by approximately 15% or more of its original diameter, such as from 0.375 in. to 0.315 in. (8.0 mm)). Fully compacted heating elements are generally preferred over partially compacted heating elements due to performance and reliability advantages, such as increased efficiency of heat transfer from the resistance wire to the sheath and increased ability to manipulate or bend the heating assembly to fit particular applications, for example.

The heating elements of the type described also include a thermal protection device, such as a thermally-actuated cutoff switch or a thermally-actuated fuse. The thermal protection device allows current to pass to the resistance wire at normal operating temperatures, but it prevents or "cuts off" the current to the resistance wire if the temperature of the heating element exceeds a predetermined threshold temperature. The thermal protection device is typically embedded in the heating element adjacent to and in a thermally conductive relationship with, the resistance wire. This is accomplished via a metal terminal pin that is connected to the resistance wire on one end and the thermal protection device on the other.

During operation of the heating element, heat generated by the resistance wire is conducted through the terminal pin to the thermal protection device. In instances where the heating element approaches and/or exceeds the predetermined temperature, the thermal protection device cuts off the current to the resistance wire.

One condition under which the heating element may exceed the predetermined threshold temperature is a "dry start;" that is, when the heating element is energized but, the heating element is not immersed in liquid. When a dry start occurs, the heating element quickly heats up to a temperature beyond its normal operating temperature such that the heating element or the appliance in which it is installed may be damaged or rendered inoperable. Therefore, it is important for the thermal protection device of the heating element to react very quickly (e.g., less than 80 seconds) to cut off the current to the heating element when the predetermined threshold temperature is reached so as to eliminate or minimize any damage to the appliance or its components.

In order to achieve the desired reaction time in the thermal protection device, the efficient transfer of thermal energy from the resistance wire to the thermal protection device is desired. In this regard, it is important to securely fasten the terminal pin to the resistance wire. The construction of known water-immersed heating elements incorporates a metal terminal pin (usually made from steel) that is welded to the resistance wire. Even better heat transfer characteristics and reaction times, however, can be achieved with terminal pins that are made from copper, since copper has superior electrical and thermal conductivity as compared to steel. A copper terminal pin, though, is not easily welded to the heating element. This is so because the material composition of the resistance wire, e.g., Fe/Cr/Al or Ni/Cr, is not suitable for welding to copper without the use of advanced welding techniques, like laser welding or ultrasonic welding, for example, which generally are not considered to be cost-effective in this application. Consequently, construction of heating elements having a copper terminal pin has employed a connection method less robust than welding. There, the coiled resistance wire of the heating element is typically attached to the terminal pin by being "screwed onto" groves that are formed in the end of the terminal pin.

While marginally acceptable in the manufacture of partially compacted heating elements, the "screw on" connection method has proved less suitable for consistent and reliable production of fully compacted heating elements. In this regard, the forces applied to the heating element for compacting the magnesium oxide are known to degrade the physical and electrical connections between the resistance wire and the terminal pin. It is not uncommon in the manufacture of fully compacted heating elements that the resistance wire and the terminal pin become fully detached. In other cases, though the heating element and terminal pin do not completely separate during compaction, the resulting heating elements exhibit a high incidence of electrical arcing at the connection between the terminal pin and the resistance wire, thereby resulting in premature failure of the heating element.

Thus, there is opportunity for improvement of known water-immersed heating elements. For example, it is desirable to provide a heating element utilizing a copper terminal pin that provides a superior connection between the terminal pin and the resistance wire even after compaction.

SUMMARY

A heating element for an appliance comprising a resistance wire and a terminal pin in electrical and thermal contact is disclosed. A connection insert is securely affixed to the terminal pin and the resistance wire is, in turn, secured to the connection insert, such as by welding. The heating element disclosed provides the ability to use a copper terminal pin in the heating element while at the same time achieving a robust electrical, thermal and mechanical connection between the terminal pin and the resistance wire which is a significant advantage over prior known heating element constructions. Optionally, a thermal protection device is located between the resistance wire and the terminal pin. In such a configuration the terminal pin permits the efficient transfer of thermal energy from the resistance wire to the thermal protection device. The thermal protection device operates to cut-off current to the resistance wire when the heating element exceeds a predetermined temperature.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
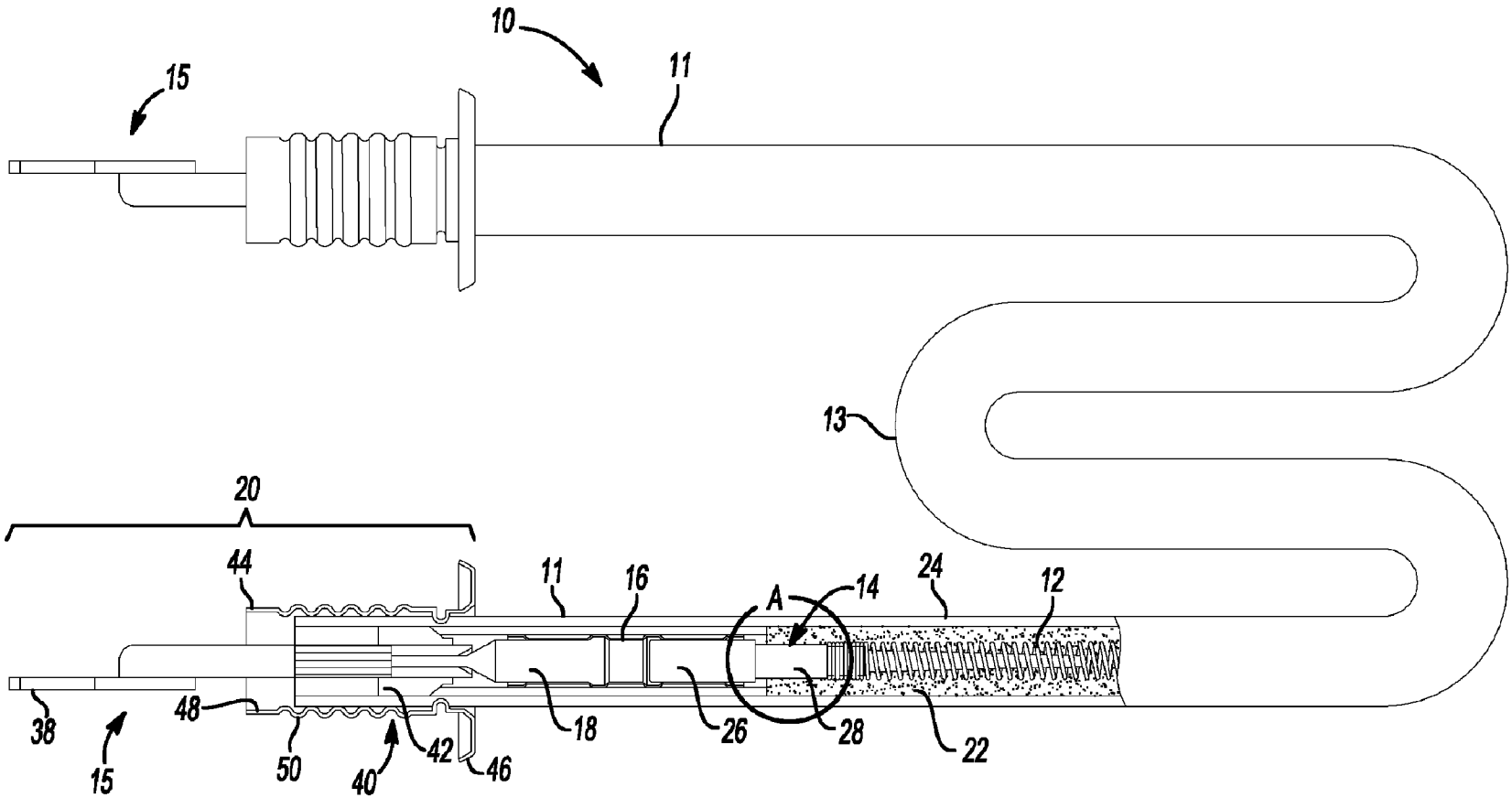
FIG. 1 is a plan view of a heating element according to the present teachings, partially in cross-section, and particularly showing the connection between a resistance wire and a thermal protection device of the heating element.

The following description is merely exemplary in nature and is not intended to limit the present disclosure, application, or uses. It should be understood that throughout the drawings, corresponding reference numerals indicate like or corresponding parts and features.

With initial reference to FIG. 1, an exemplary heating element for an appliance according to one embodiment the present teachings is illustrated at 10. As shown, this embodiment of the heating element 10 generally includes two leg portions 11 and a serpentine portion 13 extending between the leg portions 11. Each leg portion 11 terminates in an electrical connector 15 that enables the heating element 10 to be installed for use in a household appliance, for example. In one appliance installation, the heating element 10 may be used for heating water or another liquid in the appliance. There, the heating element can be immersed in the liquid to be heated. When the heating element is electrically energized, it produces heat that is transferred to the surrounding liquid. Of course, it should be understood that the foregoing merely represents one possible application for a heating element according to the present teachings, and that the heating element may be employed in many other applications.

As shown in FIG. 1, the heating element 10 comprises the components of a resistance wire 12, a terminal pin 14, a socket 16, a thermal protection device 18, and a terminal assembly 20. The resistance wire 12, the terminal pin 14, the socket 16, and the thermal protection device 18 are surrounded by an outer sheath 24. A suitable electrically insulating, thermally conductive material 22 fills the space between the resistance wire 12 and the sheath 24. An example of a thermally conductive material 22 that can be used includes granulated magnesium oxide (MgO). Particularly shown in the cross-sectioned portion of FIG. 1 is the connection between the resistance wire 12 and the thermal protection device 18 of the heating element 10.

The resistance wire 12 is any suitable resistance wire capable of acting as a heating element. Known resistance wires made from metals such as Fe/Cr/Al or Ni/Cr are suitable for use in the heating element 10. As illustrated throughout the figures, the resistance wire 12 is wound into a coil. The resistance wire 12 receives electrical current from a current source (not shown) and is in thermal and electrical contact with the terminal pin 14. The connection between the resistance wire 12 and the terminal pin 14 is illustrated in greater detail in FIG. 3.

The terminal pin 14 is any suitable electrical and thermal conductor for conducting electrical current and thermal energy between the terminal pin 14 and the resistance wire 12. The terminal pin 14 can be manufactured from a metal, such as steel. Preferably, however, the terminal pin 14 is made from solid copper to take advantage of copper's superior electrical and thermal conductivity. Alternatively, the terminal pin 14 can comprise a bimetallic construction such as a copper core steel pin, for example.

Figure 2:
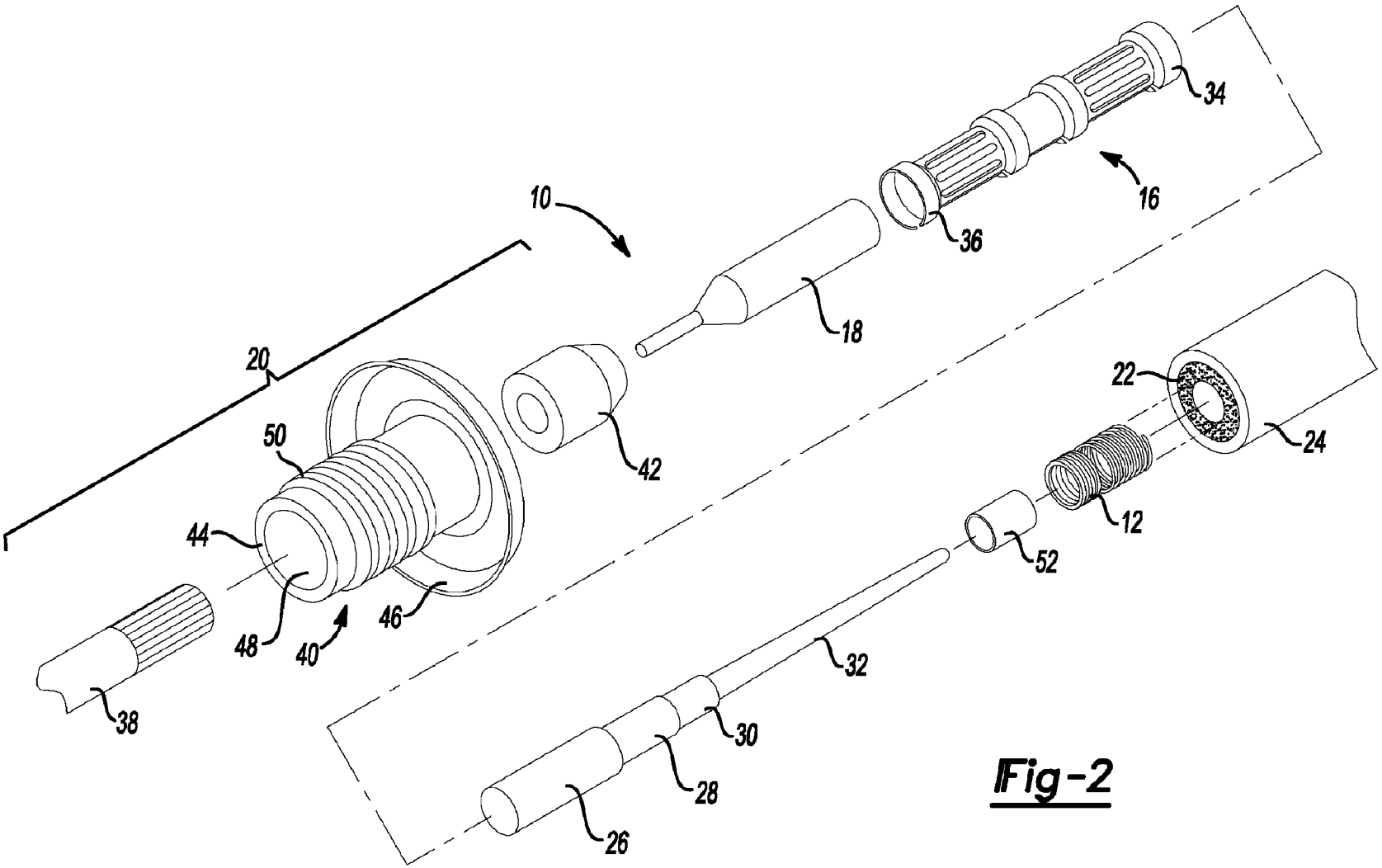
FIG. 2 is an exploded perspective view of the connection between the resistance wire and the thermal protection device shown in FIG. 1.

With additional reference to the exploded perspective view of FIG. 2, the terminal pin 14 is shown to have a generally stepped, cylindrical configuration. In particular, the terminal pin 14 includes a first portion 26 having a first outer diameter, a second portion 28 having a second outer diameter, a third portion 30 having a third outer diameter, and a stem portion 32 having a stem outer diameter. The first outer diameter is larger than the second outer diameter, the second outer diameter is larger than the third diameter, and the third outer diameter is larger than the stem outer diameter. Moreover, the stem outer diameter is conically tapered such that it progressively decreases from an end of the stem portion 32 proximate to the third portion 30 of the terminal pin 14 to an end of the stem portion 32 that is distal to the third portion 30.

The terminal pin 14 is connected to the thermal protection device 18 with any suitable connector capable of conducting electrical current and thermal energy, such as the socket 16. The socket 16 includes a first receptacle 34 and a second receptacle 36. The first receptacle 34 is sized and configured to securely receive the terminal pin 14. The second receptacle 36 is sized and configured to securely receive the thermal protection device 18. The socket 16 is made of any suitable material that possesses good electrical and thermal conductivity. Preferably, the socket 16 is made from copper.

The thermal protection device 18 is any suitable device that will terminate current flow to the resistance wire 12 when the resistance wire 12 exceeds a temperature that may cause damage to the heating element 10 or surrounding areas. For example, the thermal protection device 18 can be a thermally-actuated cutoff switch, a thermally-activated fuse, a PTC device, or the like, as are well-known in the art.

The terminal assembly 20 generally includes a connection terminal 38, a mechanical connector 40, and a sleeve 42. The mechanical connector 40 includes a main body 44 and a flange portion 46. The main body 44 defines an aperture 48. An exterior of the main body 44 include threads 50. The flange portion 46 is cylindrically-shaped and extends beyond the main body 44.

The connection terminal 38 and the thermal protection device 18 extend to within the aperture 48 where the connection terminal 38 and the thermal protection device 18 are electrically connected. The connection terminal 38 and the thermal protection device 18 are inserted into opposite ends of a spacer or tubular jacket 42 seated within the aperture 48.

The jacket 42 facilitates alignment of the connection terminal 38 with the thermal protection device 18. The jacket 42 also facilitates electrically connecting the connection terminal 38 to the thermal protection device 18.

A second terminal assembly (see FIG. 1) that is similar to the terminal assembly 20 is provided at an opposite end of the resistance wire 12.

Portions of the terminal pin 14 and the resistance wire 12 are surrounded by the conductive layer 22. The conductive layer 22 is any suitable electrically insulating, thermally conductive material. The conductive layer 22 conducts thermal energy generated by the resistance wire 12 to the outer sheath 24 and the environment surrounding the heating element 10. A suitable material for use as the conductive layer 22 is magnesium oxide (MgO).

The outer sheath 24 is any suitable material capable of transferring thermal energy generated by the resistance wire 12 from within the outer sheath 24 to the environment surrounding the heating element 10. For example, the outer sheath 24 can be made of a metal, such as steel.

Figure 3:
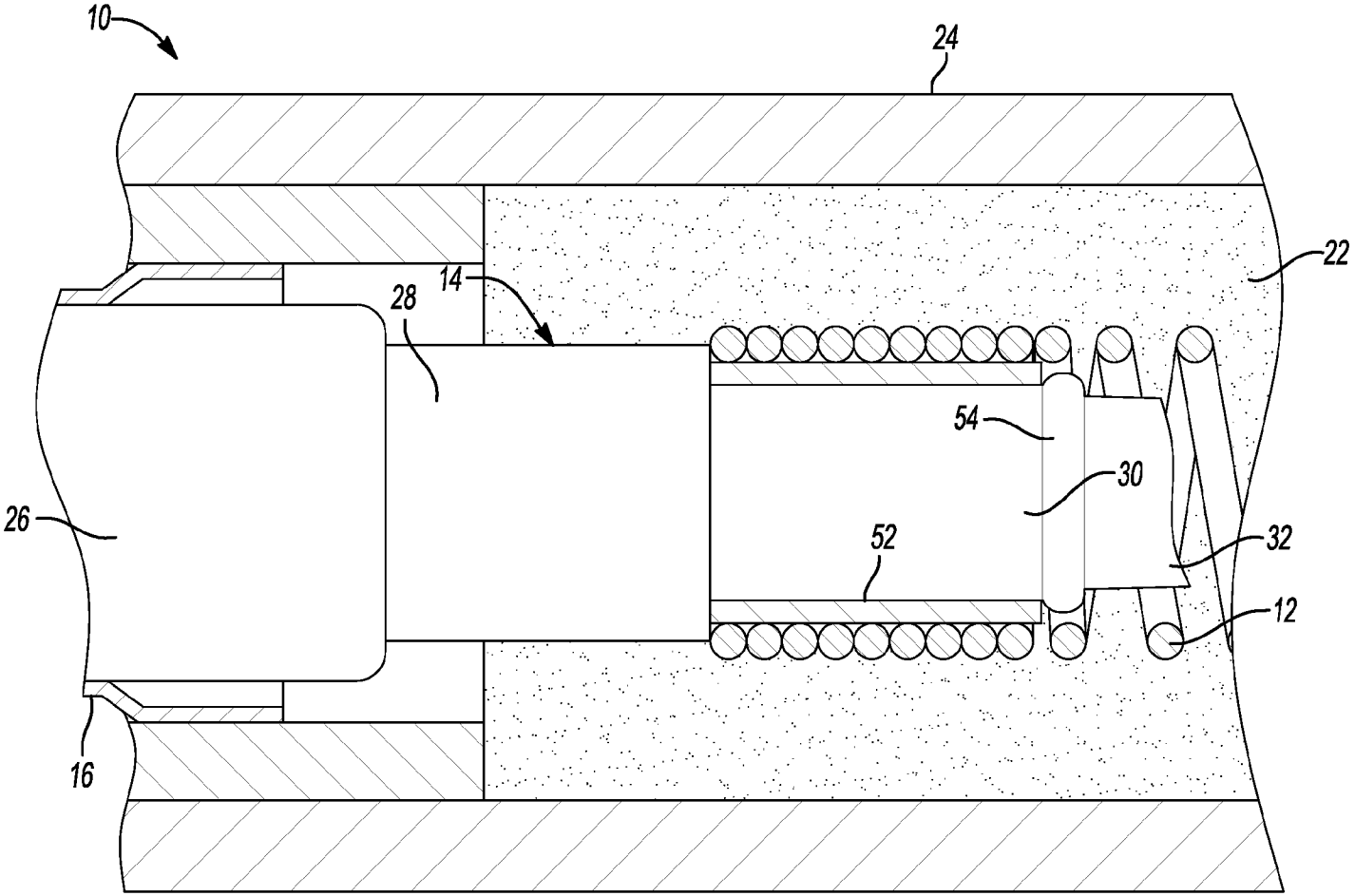
FIG. 3 is an enlarged view of detail A of FIG. 1.

With continued reference to FIGS. 1 and 2 and additional reference to FIG. 3, details of the connection between the resistance wire 12 and the terminal pin 14 are shown. The connection between the resistance wire 12 and the terminal pin 14 is facilitated by an insert or collar, illustrated as a sleeve 52, for example. The sleeve 52 is installed over the third portion 30 of the terminal pin 14. The sleeve 52 is designed having an inner diameter that is smaller than the outer diameter of the third portion 30. In particular, the inner diameter of the sleeve 52 has a diameter sufficient to provide a slight interference fit with the third portion 30 of the terminal pin 14 on the order several thousands of an inch (e.g., 0.002 in.).

The sleeve 52 comprises any suitable electrically and thermally conductive material. It is generally preferred that the sleeve 52 is made from steel so that the resistance wire 12 is can be easily welded to the sleeve 52 with conventional and cost-effective welding techniques. One method presently contemplated for securing the steel sleeve 52 to the terminal pin 14 is facilitated by first heating the sleeve 52, causing its inner diameter to expand so that the sleeve can pass over the outer diameter of the third portion 30. The inner diameter of the steel sleeve 52 then contracts as the sleeve 52 cools, thereby becoming securely attached to the terminal pin 14 with an interference fit. Of course, other manufacturing methods and techniques for attaching the sleeve 52 to the terminal pin 14 may be employed, as desired; pressing the sleeve 52 onto the terminal pin 14 being one example.

The resistance wire 12 is secured to an exterior portion of the sleeve 52. The resistance wire 12 is secured to the sleeve 52 using any device or method that will provide a secure electrical, thermal, and mechanical connection between the resistance wire 12 and the sleeve 52, and ultimately to the terminal pin 14. For example, as indicated above, the resistance wire 12 is preferably welded to the sleeve 52 to provide an extremely robust electrical, thermal, and mechanical connection. In a preferred construction, such welding may be achieved by conventional welding techniques in a cost-effective manner because the sleeve 52 and the resistance wire 12 can be made from materials that are compatible for welding.

A strong mechanical connection between the resistance wire 12 and the sleeve 52 (and terminal pin 14) is particularly important to insure that the resistance wire 12 does not separate or otherwise become completely or partially detached from the sleeve 52 (and terminal pin 14) during the manufacture of the heating element 10. In particular, during its manufacture, the heating element 10 is subjected to a reduction rolling process to fully compact or partially compact the heating element 10. Fully compacting the heating element 10 provides a number of advantages, such as: superior heat transfer characteristics; a superior ability to manipulate, form, or bend the heating element 10 to fit a particular application; superior strength of the heating element 10; and superior lifespan of the heating element 10.

One of ordinary skill in the art will appreciate that the insert or collar can take the form of any device that will provide a mechanical, electrical, and thermal connection between the resistance wire 12 and the terminal pin 14 that will not degrade under the forces generated during the reduction rolling process. For example, the insert or collar need not be a sleeve 52, but can take the form of, for example, a tab or a plate. Further, while the sleeve 52 is described as a steel sleeve, the sleeve 52 can be made of any suitable material that will provide or permit a mechanical, electrical, and thermal connection between the resistance wire 12 and the terminal pin.

To further enhance the mechanical connection between the sleeve 52 and the terminal pin 14, after the sleeve is installed on the terminal pin 14 the terminal pin 14 can be deformed to create a protrusion portion 54. In such an instance, the protrusion portion 54 is provided between the third portion 30 and the stem portion 32. As shown in FIG. 3, the protrusion portion 54 projects beyond the inner diameter of the sleeve 52, but not as far as the outer diameter of the sleeve 52. The protrusion portion 54, as shown, can be formed by applying pressure to the terminal pin 14 at opposite sides the third portion 30. Doing so deforms the terminal pin 14, creating an indentation in the third portion 30 in one direction while creating the protrusion portion 54 in a direction perpendicular to the indentation. Alternatively, the protrusion portion 54 can extend from the terminal pin 14 at discrete points about the circumference of the terminal pin 14, or it can take the form of an annular rim that extends completely around the circumference of the terminal pin 14.

In an alternate construction of the heating element 10 incorporating a terminal pin 14 having a bimetallic construction, such as a copper core steel pin, the resistance wire 12 may be attached in a secure manner directly to the terminal pin 14 preferably, by conventional welding techniques. In this regard, the exterior surface material the bimetallic terminal pin 14 and the resistance wire 12 can be made from materials that are compatible for welding.

In operation, the heating element 10 is connected to a circuit of an appliance at its terminal assemblies 20. A current source (not shown) such that the connection terminal 38 is in electrical contact with the current source. The mechanical connection between the terminal assembly 20 and the circuit of the appliance is enhanced through cooperation between the threads 50 and corresponding threads of the appliance.

Current is conducted through the connection terminal 38, the thermal protection device 18, the socket 16, the terminal pin 14, and the sleeve 52 to the resistance wire 12. The high resistance of the resistance wire 12 causes the wire 12 heat up (e.g., $I^2r$ heating) when current is applied to the wire 12. The thermal energy generated by the resistance wire 12 is conducted by the conductive layer to the outer sheath 24. A heat transfer then takes place between the outer sheath 24 and the environment in which the heating element 10 is operating.

Thermal energy generated by the resistance wire 12 is also conducted through the sleeve 52, to the terminal pin 14 and the socket 16, and to the thermal protection device 18. If the thermal energy detected at the thermal protection device 18 exceeds a predetermined threshold, the thermal protection device opens the circuit to interrupt the flow of electrical current to the resistance wire 12. When the heating element 10 is used in a dishwasher for example, the predetermined threshold can be set to a temperature at which the heating element 10 or other portions of the dishwasher may be damaged under dry start conditions.

Figure 4:
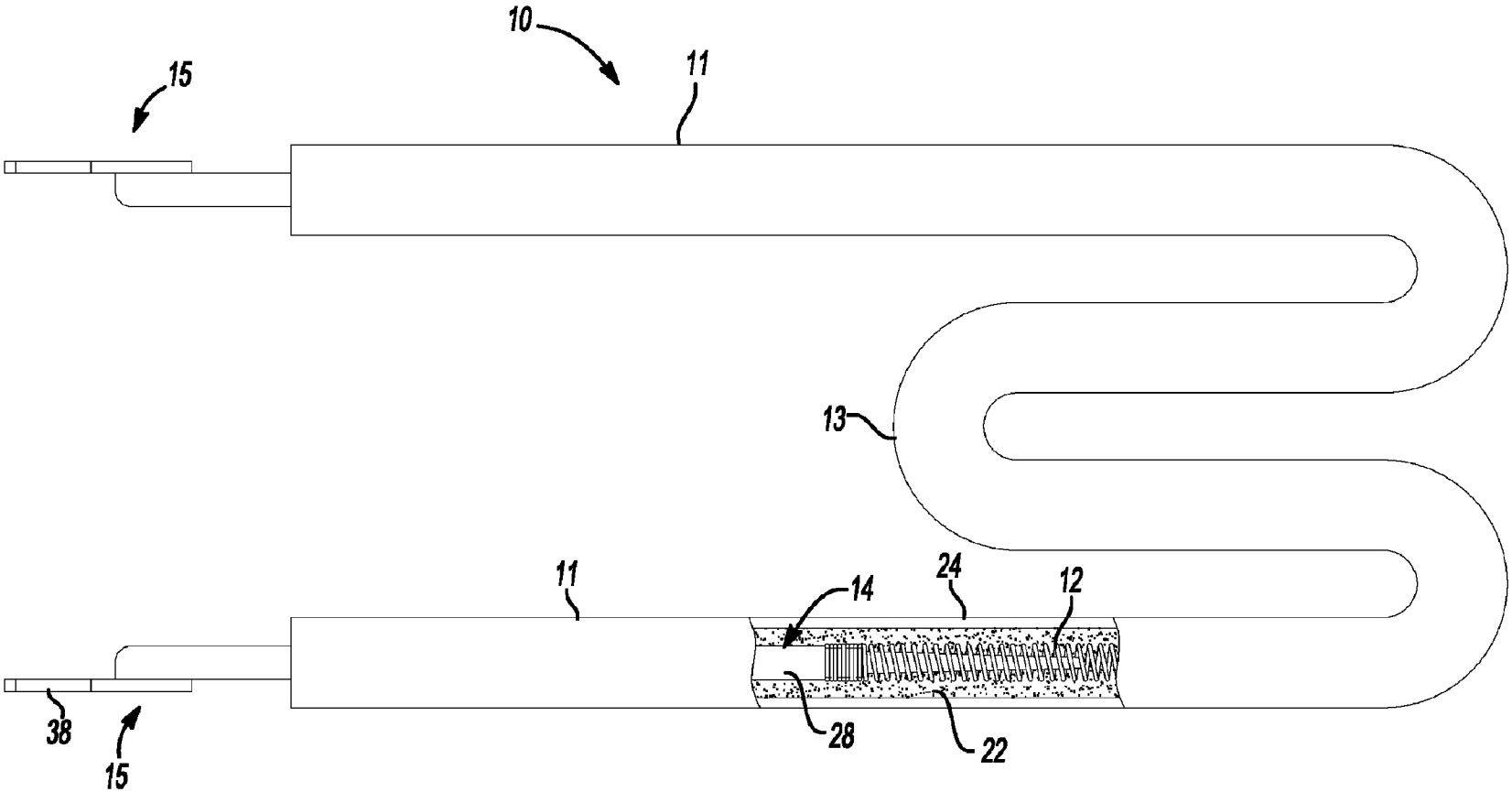
FIG. 4 is a plan view similar to that of FIG. 1, of an alternate embodiment of a heating element according to the present teachings.

An alternate construction for a heating element without an integrated thermal protection device is shown in FIG. 4 at 100. Similar to the heating element 10 shown in FIG. 1, the heating element 100 is shown to generally include two leg portions 11 and a serpentine portion 13 extending between the leg portions 11. Each leg portion 11 terminates in an electrical connector 15 having a connection terminal 38 for connection to a current source (not shown).

The heating element 100 is illustrated as further comprising a resistance wire 12 and a terminal pin 14 surrounded by an outer sheath 24. A electrically insulating, thermally conductive material 22, such as magnesium oxide, fills the space between the resistance wire 12 and the sheath 24. Shown in the cross-sectioned portion of FIG. 4 is the connection between the resistance wire 12 and the thermal protection device 18 of the heating element 10 substantially as described.

What is claimed is:

1. A heating element comprising:

an electrically conductive terminal pin comprising a cylindrical portion and a conically tapered stem portion, the cylindrical portion located next to the conically tapered stem portion;

an electrically and thermally conductive connection member having a constant inner diameter, the connection member attached to the terminal pin with an interference fit, the connection member directly engaging the terminal pin and only at the location of the cylindrical portion; and a resistance wire fixedly attached directly to an outer surface of the connection member.

2. The heating element of claim 1, wherein the terminal pin further comprises a protrusion portion abutting a side of the connection member, the protrusion portion having an outer dimension that is greater than the inner diameter of the connection member.

3. The heating element of claim 1, wherein the resistance wire is welded to the connection member.

4. The heating element of claim 3 further comprising a thermal protection device, said terminal pin operable to conduct thermal energy from the resistance wire to the thermal protection device.

5. The heating element of claim 3 further comprising an outer sheath covering the terminal pin, the connection member, and the resistance wire; and magnesium oxide disposed in the space between the resistance wire and the outer sheath.

6. The heating element of claim 5, wherein the heating element is partially compacted.

7. The heating element of claim 5, wherein the heating element is fully compacted.

8. The heating element of claim 1, wherein the terminal pin further comprises a second portion having a second diameter located adjacent to the cylindrical portion, the second diameter being greater than the inner diameter of the connection member; and wherein the connection member is located adjacent to the second portion of the terminal pin.

9. The heating element of claim 3, wherein the connection member is a generally cylindrically shaped, hollow sleeve and the terminal pin extends through the connection member.

10. A heating element comprising:

a terminal pin;

a connection insert secured over the terminal pin; and a resistance wire fixedly secured directly to the connection insert;

wherein the connection insert is a generally cylindrically shaped, hollow annular sleeve and the terminal pin extends through the sleeve; and wherein the terminal pin further comprises a first portion on a first side of the annular sleeve and a second portion on a second side of the annular sleeve, the annular sleeve disposed between the first portion and the second portion, the first portion having a first diameter that is larger than an outer diameter of the annular sleeve and the second portion having a second outer diameter that is less than the outer diameter of the annular sleeve and greater than an inner diameter of the annular sleeve.

11. A heating element for an appliance comprising:

a thermal protection device;

a copper terminal pin connected to the thermal protection device, the terminal pin extending along a longitudinal axis and comprising a first portion having a first axial length and a first constant diameter, and a second portion located adjacent to the first portion comprising a conically tapered stem portion;

a steel insert having a second axial length less than or equal to the first axial length of the first portion of the terminal pin and comprising an annular inner surface, the insert fixedly attached to the first portion of the terminal pin along the second axial length, the inner surface of the insert directly engaging an outer surface of the first portion of the terminal pin;

a resistance wire fixedly secured to an outer surface of the insert;

a thermally conductive layer surrounding the resistance wire; and an outer sheath surrounding the thermal protection device, the terminal pin, the resistance wire, and the conductive layer.

12. The heating element of claim 11, wherein the terminal pin extends through the insert.

13. The heating element of claim 12, wherein the insert is secured to the terminal pin with an interference fit.

14. The heating element of claim 11, wherein the heating element is partially compacted.

15. The heating element of claim 11, wherein the heating element is fully compacted.

16. The heating element of claim 11, wherein the terminal pin further comprises third portion having a diameter greater than the first constant diameter; and the insert is secured to the terminal pin adjacent to the third portion.

17. The heating element of claim 11, wherein the terminal pin further comprises a protrusion portion on a side of the insert, the protrusion portion having an outer dimension that is greater than an inner dimension of the insert and less than an outer dimension of the insert.

* * * * *